US005174143A

United States Patent [19]

Martin

[11] Patent Number: 5,174,143

[45] Date of Patent: Dec. 29, 1992

[54] SURFACE DENSIFICATION OF POROUS MATERIALS

[75] Inventor: R. L. Martin, St. Charles, Mo.

[73] Assignee: McDonnell Douglas Corporation, St. Louis, Mo.

[21] Appl. No.: 788,234

[22] Filed: Nov. 5, 1991

[51] Int. Cl.[5] ..... B24C 1/00

[52] U.S. Cl. ..... 72/53; 148/512; 29/90.1

[58] Field of Search ..... 72/53; 148/512, 514; 51/319, 320; 29/90.1

[56] References Cited

U.S. PATENT DOCUMENTS

| | | | |
|---|---|---|---|
| 2,215,723 | 9/1940 | Jones . | |
| 3,114,961 | 12/1963 | Chambers et al. . | |
| 3,183,086 | 5/1965 | Kurtz et al. . | |
| 3,318,696 | 5/1967 | Krock et al. . | |
| 3,806,692 | 4/1974 | Few | 219/121 EM |
| 3,816,233 | 6/1974 | Powers | 161/159 |
| 4,059,879 | 11/1977 | Chmura et al. | 29/148.4 |
| 4,164,526 | 8/1979 | Clay et al. | 264/45.3 |
| 4,232,436 | 11/1980 | Chmura | 29/148.4 |
| 4,956,137 | 9/1990 | Dwivedi | 264/60 |

FOREIGN PATENT DOCUMENTS

| | | | |
|---|---|---|---|
| 1-208415 | 8/1989 | Japan | 72/53 |
| 2-25624 | 9/1990 | Japan | 148/512 |

OTHER PUBLICATIONS

Michael Woelfel and Robert Mulhall, "Glass Bead Impact Blasting", Sep. 1982, pp. 57-58.

*Primary Examiner*—David Jones

*Attorney, Agent, or Firm*—Timothy H. Courson; Benjamin Hudson, Jr.

[57] ABSTRACT

A method for producing a densified layer on the surface of a porous material having gas-containing voids which includes: (1) heating the outer surface of the porous material to cause localized removal of the gas contained in the voids so that the voids coalesce and form surface-connected channels, and (2) deforming the surface of the porous material to close the surface-connected channels so that a distinct, densified layer is formed at the surface of the porous material. The method is particularly applicable to the production of lightweight structural components.

6 Claims, 1 Drawing Sheet

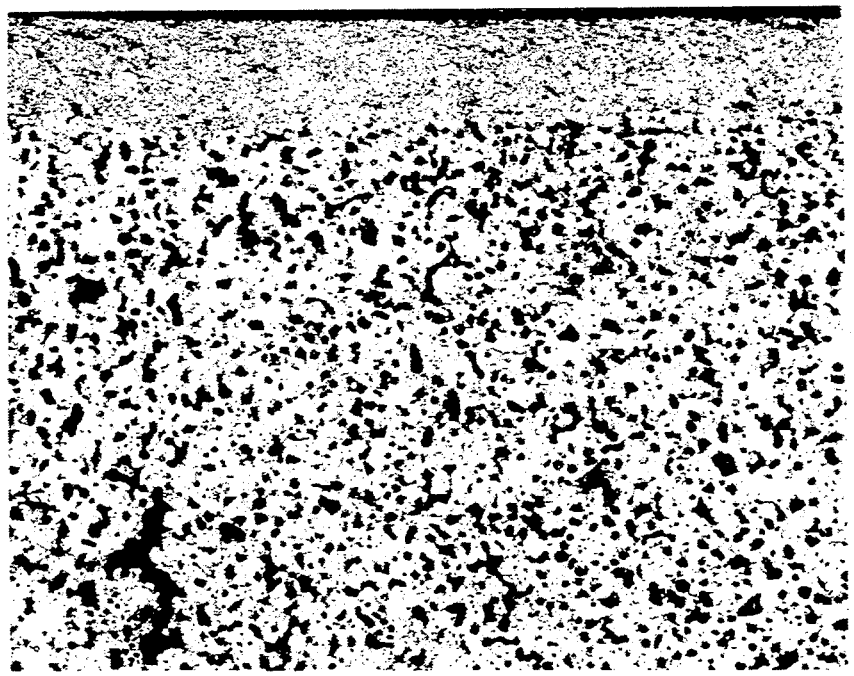

SURFACE DENSIFICATION OF POROUS MATERIALS

BACKGROUND OF THE INVENTION

This invention relates to a method for producing structures having a densified layer on the outer surface of a porous material.

Numerous methods for producing lightweight, load-bearing structural components for such applications as airframe components and construction materials have been proposed. For example, lightweight structural components have been fabricated using a "sandwich" construction in which facesheets are bonded to a porous core. Although this arrangement increases the bending and buckling section properties, there are a number of disadvantages: 1) the bonded joints between the core and the facesheets are often inconsistent, reducing reliability and causing overdesign which limits weight efficiency, 2) fabrication costs are high due to complex forming, core cutting, assembly, and joining steps, and 3) production of thin sections are unfeasible due to fabrication difficulties.

As disclosed in U.S. Pat No. 4,659,546, the disclosure of which is hereby incorporated by reference, porous material bodies used for load-bearing applications often employ trapped gas to create discrete internal porosity and reduce the overall density of the body. Since they contain sufficient shear strength to support solid facesheets under bending loads, such porous materials are often used as the core for sandwich construction of lightweight components.

There is a need in the art for an in-situ method of producing lightweight, non-sandwich structural components from porous materials having gas-containing voids.

SUMMARY OF THE INVENTION

The method of the present invention allows in-situ, solid-state elimination of porosity from a zone at the surface of a porous material having gas-containing voids. The resulting densified layer on the surface of the porous material has a chemical composition identical to the porous core, and a continuous, high integrity interface exists between the densified surface and the porous core.

The method disclosed herein includes: (1) heating the outer surface of the porous material to cause localized removal of gas contained in the voids so that the voids coalesce and form surface-connected channels, (2) deforming the surface of the porous materials to close the surface-connected channels so that a distinct, densified layer is formed at the surface of the porous material.

BRIEF DESCRIPTION OF THE DRAWING

Other objects, features, and advantages of the present invention will become more fully apparent from the following detailed description of the preferred embodiment, the appended claims, and the accompanying FIGURE. The FIGURE is a photomicrograph (50 magnification) of a product formed from the method of the present invention as described in Example 1.

DETAILED DESCRIPTION OF THE PREFERRED EMBODIMENT

The method of the present invention may be performed on any porous material having gas trapped within its voids. The surface of such porous material is heated at a temperature sufficient to cause localized removal of the gas contained in the voids; the higher internal pore pressure and reduced material flow strength resulting from such intense localized heating causes rapid expansion of the gas pores. As expansion of the pores in the surface region progresses, the solid walls between pores rupture and the pores coalesce; furthermore, the walls separating the pores from the surface of the material also rupture. The interconnected network of expanded, coalesced cells are open to the surface and allow the gas to escape. Accordingly, a layer having surface-connected channels is formed at the surface of the porous material. In an alternative embodiment of the present invention, heating the surface of the porous material can be carried out in a chemical environment which accelerates the removal of gas.

Due to the temporary application of the heating source and the chilling action of the subsurface material under the dynamic heating conditions described above, a temperature gradient exists which causes some point below the surface of the material to have a sufficiently low temperature such that internal pore pressure does not exceed the material flow strength. At this depth, the porous material remains unaffected yet integral with the region of material which has undergone gas removal. The thickness of the dense portion formed at the surface of the porous material is controlled by varying the thermal balance created by the external heat source: a sharper temperature gradient below the surface of the material produces a thinner, degassed layer, while a gradual temperature gradient produces a thicker, degassed layer.

The heating conditions necessary to create a temperature gradient at the surface of the porous material can be produced by any suitable means such as belt furnaces, flash heating in a stationary furnace, defocusing a laser or electron beam and traversing it along the material surface, or generating heat by friction at the surface of the porous material (e.g., controlled grinding, blasting, machining, etc.).

Either in combination with the degassing step, or as a distinctly separate step, the surface of the porous material is mechanically deformed to close off the surface-connected channels to form a distinct, densified layer at the surface of the porous material. Surface deformation can be enhanced by establishing a more formable material microstructure within a surface zone during the intial heating step.

In one embodiment of the present invention, surface deformation is created by a combination of mechanical and thermal means. By rolling relatively thick sections of the porous material (e.g., greater than 0.050 inches thick) with small diameter rolls in a 4-high configuration, the high contact stress over a small area produces localized surface deformation which causes material flow into existing surface voids. Subsequent heat-treatment at intermediate temperatures creates diffusion across the walls of the collapsed pores to heal the remaining seam.

In another embodiment of the present invention, surface deformation is achieved by blasting the porous material with metal or glass shot which has a diameter larger than the surface void openings. The localized compressive forces caused by the impinging shot causes material flow into the existing surface voids. Subsequent heat-treatment creates diffusion to further improve the integrity of the material.

The invention will be further clarified by a consideration of the following examples, which are intended to be purely exemplary of the use of the invention.

EXAMPLE 1

A porous titanium alloy (Ti-6-4) plate was produced by introducing inert gas to titanium alloy particulate in a rectangular container prior to sealing. After consolidation by hot isostatic pressing, a high temperature anneal produced approximately 25 volume percent discrete gas porosity in the matrix. The titanium cannister material was mechanically removed leaving the surface of the porous Ti-6-4 plate exposed.

The surface of the porous plate was treated with a grinding wheel turning at 1500 revolutions per minute with a 0.5 inch per second travel rate over the surface. The depth of passes was approximately 0.001 inch per pass. As no liquid medium was used to cool the surface of the part, the grinding operation produced intense local heat at the point of friction. The intense heat generated in the contact areas caused rapid expansion and coalescence of the gas pores from the surface to 0.007 inches below the surface. The inert gas escaped through openings developed at the surface of the part caused by the growth and interconnection of the pores.

Subsequent passes at 0.003 inch depth created sufficient pressure and heat at the degassed surface zone to cause metal flow which resulted in closure of the surface-connected channels. Since the underlying porous material rapidly chilled the heated surface zone, the time at high temperature due to friction was extremely short, so diffusion of contaminants such as oxygen was minimized preventing any degradation to the titanium. As shown in the FIGURE, a densified, pore-free layer measuring approximately 0.007 inches thick was created. The same process was repeated on the opposite side of the porous plate sample. The result was a structurally efficient Ti-6-4 panel possessing higher specific bending stiffness than a solid Ti-6-4 plate with equivalent weight.

EXAMPLE 2

A rectangular plate sample from porous Ti-6 wt % Al-4 wt % V was produced in the same manner described in Example 1, and placed into an electron-beam welding chamber. The chamber was mechanically pumped to a vacuum level of 0.01 torr. The electron-beam welder was programmed to make a single pass across the top of the porous plate under the following conditions: 200 HV, 25 mA, a 550 beam focus at a 10 inch gun distance, with beam movement at 15 inches per minute. The electron beam intersected an area 3 inches in diameter on the surface of the porous plate as it traveled from end to end, leaving a 0.005 inch surface zone which had been degassed due to rapid expansion and coalescence of gas pores under the intense local heat.

The porous plate, which had a total thickness of 0.125 inches, underwent repetitive blows by a 1 kilogram steel hammer, to close surface-connected channel voids, creating a 0.005 inch thick sound densified layer. A 1300° F., 2 hour heat-treatment was applied to the plate after deformation processing to create diffusion across collapsed channel voids to further improve the integrity of the densified layers.

Other embodiments of the present invention will be apparent to those skilled in the art from a consideration of this specification or practice of the invention disclosed herein. It is intended that the specification and examples be considered as exemplary only, with the true scope and spirit of the invention being indicated by the following claims.

I claim:

1. A solid-state method of producing a distinct, densified layer on the surface of a porous material having gas-containing voids, comprising the steps of:

(a) heating the outer surface of said porous material to a temperature below its melting point but above a critical temperature to locally remove said gas contained in said voids, whereby said voids coalesce to form surface-connected channels; and (b) deforming said surface of said porous material to close said surface-connected channels.

2. The method as recited in claim 1, wherein said heating step is accomplished by defocusing an electron beam and traversing said electron beam along said surface of said porous material.

3. The method as recited in claim 1, wherein said heating step is accomplished by creating friction at said surface of said porous material.

4. The method as recited in claim 1, wherein said deforming step is accomplished by blasting said surface of said porous material with metal shot.

5. A method of producing a distinct, densified layer on the surface of a porous material having gas-containing voids, comprising the steps of:

(a) heating the outer surface of said porous material to a temperature below its melting point but above a critical temperature to locally remove said gas contained in said voids, whereby said voids coalesce to form surface-connected channels; and (b) deforming said surface of said porous material to close said surface-connected channels, wherein said deforming step is accomplished by grinding said surface of said porous material.

6. The method as recited in claim 1, wherein said deforming step is accomplished by blasting said surface of said porous material with glass shot.

* * * * *